US006371896B1

(12) United States Patent
Kettler

(10) Patent No.: US 6,371,896 B1
(45) Date of Patent: Apr. 16, 2002

(54) EXERCISE APPARATUS AND PROCESS OF ADJUSTING SAME

(75) Inventor: Heinz Kettler, Ense-Parsit (DE)

(73) Assignee: Heinz Kettler GmbH & Co., Ense-Parsit (DE)

( * ) Notice: Subject to any disclaimer, the term of this patent is extended or adjusted under 35 U.S.C. 154(b) by 0 days.

(21) Appl. No.: 09/493,681

(22) Filed: Jan. 28, 2000

(30) Foreign Application Priority Data

Jan. 29, 1999 (DE) ..... 299 01 571 U

(51) Int. Cl.[7] ..... A63B 26/00

(52) U.S. Cl. ..... 482/142; 482/908; 297/13; 297/14; 297/38

(58) Field of Search ..... 482/142, 99–102, 482/907, 908; 128/845, 846; 297/284.7, 284.8, 13, 14, 38, 1, 230.14; 606/200

(56) References Cited

U.S. PATENT DOCUMENTS 4,746,114 A * 5/1988 Grider ..... 482/104
5,830,115 A * 11/1998 Chen ..... 482/96
5,860,899 A * 1/1999 Rassman ..... 482/142

* cited by examiner

*Primary Examiner*—Jerome W. Donnelly
*Assistant Examiner*—Lori Baker Amerson
(74) *Attorney, Agent, or Firm*—Greenblum & Bernstein, P.L.C.

(57) ABSTRACT

Exercise apparatus and process of adjusting the exercise apparatus. The exercise apparatus includes a basic frame, a bench unit, including a back part and a seat part, which is vertically adjustable on the basic frame between a sitting position and a lying position, and a curved guideway, including at least one substantially straight section, that is arranged to positionally adjust the back part. The process includes moving the bench unit so that the back part and the seat part are positionable between a lying position and a seated position. The back part is moved along a path defined by the curved guideway.

32 Claims, 4 Drawing Sheets

EXERCISE APPARATUS AND PROCESS OF ADJUSTING SAME

CROSS-REFERENCE TO RELATED APPLICATIONS

The present application claims priority under 35 U.S.C. § 119 of German Patent Application No. 299 01 571.8, filed on Jan. 29, 1999, the disclosure of which is expressly incorporated by reference herein in its entirety.

BACKGROUND OF THE INVENTION

1. Field of the Invention

The present invention relates to an exercise apparatus, e.g., a dumbbell bench, and a process for adjustably positioning the exercise apparatus. The exercise apparatus includes a basic frame and a bench unit which is supported in a vertically adjustable manner on the basic frame. The bench unit includes a back part and a seat part which are adjustable between a sitting position and a lying position.

2. Discussion of Background Information

Dumbbell benches are used in many ways in fitness studios. These known dumbbell benches include a basic frame which has fixedly mounted thereon a seat part. The one end of the bench seat is followed by a back part which is pivotable about a pivot point between the back part and the seat part to adjust the inclination of the back part step by step between a lying position and a sitting position. The back part is fixed in the respective position via a rod which is hingedly arranged on the back part and which, in turn, engages with its other end into bars. The bars are secured at an inclined plane at regular intervals so that different inclined positions of the back part are obtained by the bars cooperating with the rod of the back part.

As an alternative to such a way of fixing, dumbbell benches are also produced in the case of which the back is provided at its end facing the head with one or two hook elements which can be hung into horizontal bars of so-called wall bars. The angle of inclination of the back part which is pivotably secured to the basic frame is adjusted in accordance with the hanging operation performed on a selected horizontal bar.

The two methods of adjusting the back are based on the same principle, i.e., to use the end of the back part which is articulated to the basic frame as a fixed pivot point and to pivot the other end of the back part in circular fashion around the pivot point and to fix the other end in a corresponding inclined position. It has been found to be a drawback that users of the dumbbell bench who have different heights cannot often adjust the optimum exercise position because the known dumbbell benches have been conceived on the basis of the standard or average height of man. Consequently, users of the known dumbbell benches who are greater or smaller than the average have to make do with a suboptimal training position. However, there is the risk of damage to the user's health due to an initial position that is not optimum for the person performing exercises on the dumbbell bench.

SUMMARY OF THE INVENTION

The present invention provides an exercise apparatus, e.g., a dumbbell bench, and a process of adjusting the exercise apparatus of the above-mentioned generally discussed above which is a simple construction and can be produced easily at low costs. Moreover, the apparatus permits adjustment of an optimum training position for the user of the exercise apparatus at the same time.

According to the exercise apparatus of the present invention, the position of the back part is adjustable along a curved guideway having at least one straight section.

Thus, the exercise apparatus of the invention offers several advantages. The guideway of the back part automatically effects an optimum training position upon an adjusting operation so that the exercising person will always keep an optimum distance from a dumbbell bar according to the respectively adjusted position of the seat and back part. Moreover, possible damage to the user's health is avoided by the optimum initial position of the exercising person.

Furthermore, the adjustment along the guideway of the invention can be carried out easily so that the exercising person can rapidly carry out the adjustment independently, i.e. without the help of others.

Preferably, the bench unit includes a vertically adjustable support tube which is guided on the basic frame, an adjustment tube which is connected with one end to the support tube and carries the back part and seat part, and a shaft tube which is secured to the other end of the adjustment tube. Such a construction of the bench unit can be obtained easily because such elements can be provided as standard components. As a result, the production costs can be reduced to a minimum amount.

To provide an exercise apparatus which is as simple as possible and which is suited for operation over a long period of time, the adjustment tube should preferably include a carrier tube and an adjustment element which is slidably and fixably guided on the carrier tube. Such adjustment tubes are commercially available and are suited for permanent use. At the same time, the costs are kept low.

Preferably, the curved guideway has different radii, so that the exercising person can always assume the optimum position of the back part and seat part in accordance with orthopedic requirements while performing exercises with dumbbells on the exercise apparatus.

In accordance with an exemplary embodiment of the present invention, the curved guideway can be formed as a support bow. A support bow can be produced easily and exhibits an adequate strength with respect to great forces acting thereon.

To achieve a construction of the exercise apparatus of the instant invention that is as simple as possible, the support bow may be rigidly secured to a surface of the back part that faces the basic frame, and may be pivotably secured to the adjustment element. This also permits an easy adjustment of the back part so that only the adjustment element has to be moved along the carrier tube and fixed.

To achieve a suitable guidance of the support bow while a position of the back part is adjusted, the support bow is supported on a rest which can be arranged on the support tube. In this manner, a simple and reliable arrangement can be created as a guide device for the support bow.

To make the guide device of the support bow simple and inexpensive, the rest part can be formed or designed as a slide roll.

In a further exemplary embodiment of the present invention, the seat part can be pivotably secured to the adjustment element and can be adjustable together with the back part. As a result, only a single component, i.e., the adjustment element, is required for adjusting both the position of the back part and the position of the seat part. In this way, the user friendliness of the exercise apparatus of the invention is enhanced. Further, in contrast to the known dumbbell benches, the position of the seat part is also changed when the position of the back part is adjusted. Accordingly, an optimum position between the buttocks and the back of the user can be achieved during each positional adjustment of the exercise apparatus of the invention.

Finally, the fastening point of the seat part and back part that serves as a pivot point may be located on the adjustment element below the seat part, which can result in further optimization of the relative positioning of seat part and back part during the positional adjustment of the back part.

The present invention is directed to an exercise apparatus that includes a basic frame, a bench unit, including a back part and a seat part, which is vertically adjustable on the basic frame between a sitting position and a lying position, and a curved guideway, including at least one substantially straight section, that is arranged to positionally adjust the back part.

According to a feature of the instant invention, the bench unit can further include a vertically adjustable support tube adapted for movement on the basic frame, an adjustment tube having an end coupled to the support tube, in which the adjustment tube is adapted to carry the back part and the seat part, and a shaft tube pivotably coupled to an other end of the adjustment tube.

In accordance with another feature of the invention, the adjustment tube can include a carrier tube and an adjustment element. The carrier tube can be movably and fixably coupled to the carrier tube. The curved guideway can include a plurality of different radii, and the curved guideway can include a support bow.

Further, the support bow can be rigidly coupled to a surface of the back part arranged to face the basic frame and can be pivotably coupled to the adjustment element.

Still further, a rest can be arranged on the support tube, and the support bow may be supported on the rest. The rest can be a slide roll. The seat part can be pivotably coupled to the adjustment element and can be adjustable together with the back part. Further, the back part and the seat part may be pivotably coupled together at an attachment point, the attachment point can be positioned on the adjustment element below the seat part.

According to still another feature of the present invention, the apparatus can be a dumbbell bench.

The present invention is directed to an exercise apparatus that includes a positionably adjustable bench unit having a back part and a seat part. The back part is pivotably coupled to the seat part, the seat part is movable along a substantially straight path, and the back part is movable along a curved path.

According to a feature of the instant invention, the apparatus further includes a base frame having an upright part and a base part, a shaft tube, and an extendible tube coupled between the upright part and the shaft tube. The seat part may be movable along the extendible tube.

The apparatus can also include a support tube adjustably coupled for movement along the upright part, and a guide element including at least one substantially straight portion and at least one curved portion. The guide element may be slidably coupled to the support tube. The curved portion can include a plurality of different radii, and a rest can be coupled to the support tube, so that the guide element may be slidably supported by the rest. The rest can include a plastic roller.

According to another feature of the present invention, the extendible tube can include a carrier tube and an adjustment element. The adjustment element may be slidably coupled to the carrier tube to selectively adjust a length of the extendible tube.

According to still another feature of the instant invention, a support element coupled to the seat part can be adapted to pivotably adjust a position of the seat part on the extendible tube.

In accordance with a further feature of the invention, the extendible tube may be positionably adjustable along the upright part.

Still further, the extendible tube may be pivotably coupled to the tube shaft and pivotably coupled to the upright part.

According to still another feature of the present invention, the tube shaft can include an extendible tube for adjusting a length of the tube shaft.

Moreover, an equipment holder can be provided. The equipment holder may be positionable along the upright part.

According to a still further feature of the invention, a roll can be coupled to upper end of the tube shaft.

An attachment element can pivotably couple the seat part to the back part, and the attachment element may be arranged for slidable engagement with the extendible tube.

In accordance with another feature of the instant invention, a guide element can include at least one substantially straight portion and at least one curved portion. The guide element may be fixedly coupled to the back part and pivotably coupled to the seat part. A support tube may be coupled to the upright part, and the guide element can be slidably coupled to the support tube.

The present invention is also directed to a process of adjusting an exercise apparatus that includes a basic frame, a bench unit, which includes a back part and a seat part, and a curved guideway, which includes at least one substantially straight section. The process includes moving the bench unit so that the back part and the seat part are positionable between a lying position and a seated position. The back part is moved along a path defined by the curved guideway.

According to a feature of the invention, the seat part can be movable along a straight path.

In accordance with yet another feature of the invention, the seat part and the back part can by pivotably coupled to each other.

The invention is also directed to an exercise apparatus that includes a positionably adjustable bench unit, comprising a back part and a seat part. The back part is pivotably coupled to the seat part, the seat part is movable along a substantially straight path, and the back part is movable along a curved path. The apparatus also includes a base frame having an upright part and a base part, a shaft tube, and an extendible tube, including a carrier tube and an adjustment element, pivotably coupled to the upright part and pivotably coupled to the shaft tube. The seat part is movable along the extendible tube, and the adjustment element is slidably coupled to the carrier tube to selectively adjust a length of the extendible tube.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
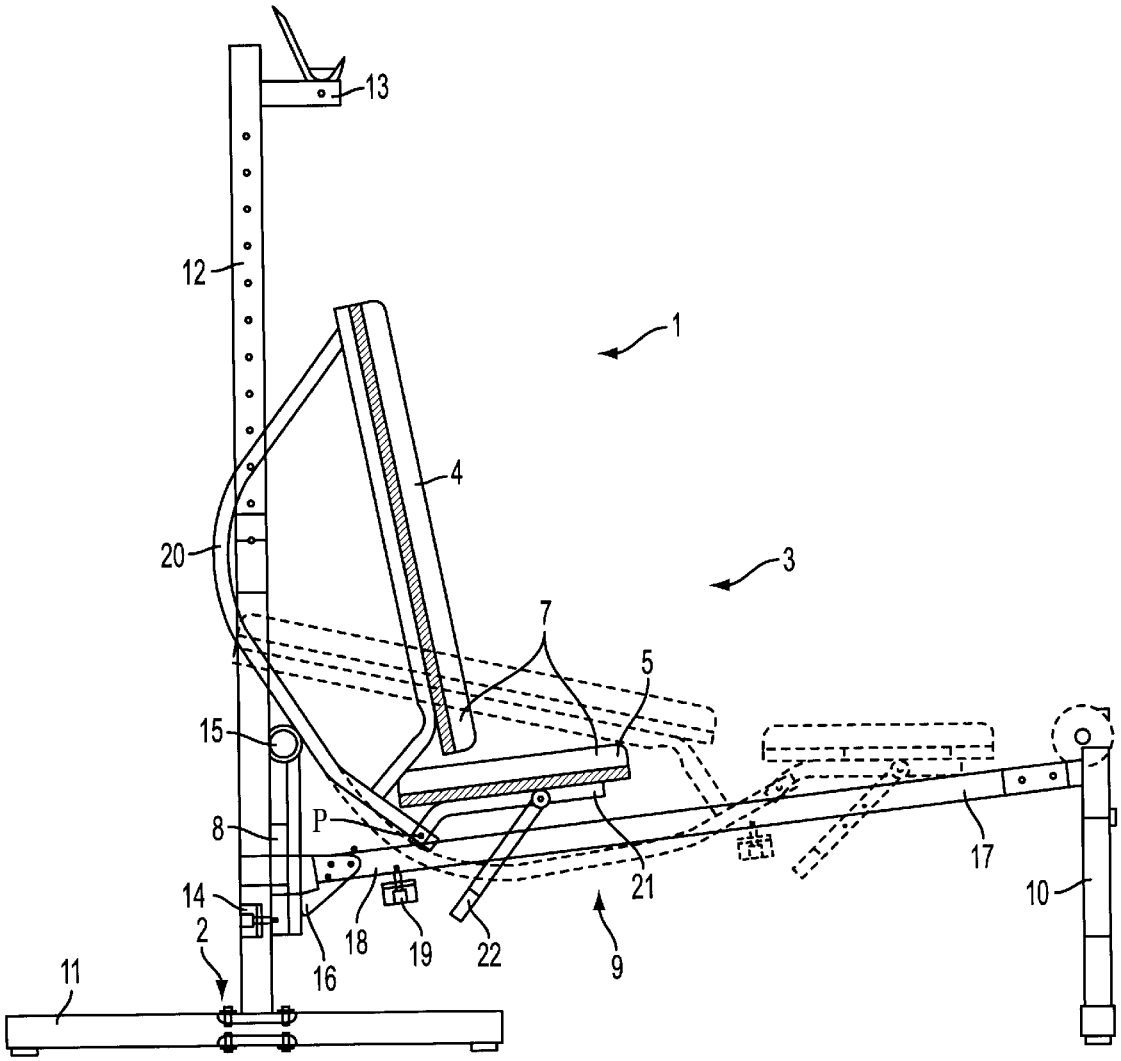
FIG. 1 illustrates a lateral sectional view of an exercise apparatus of the instant invention in a sitting position and in a lying position.

FIG. 1 illustrates a lateral sectional view of an exercise apparatus of the instant invention, e.g., a dumbbell bench. The dumbbell bench 1 can include a basic frame 2 and a bench unit 3, which is supported in a vertically adjustable manner on basic frame 2. Bench unit 3 includes a back part 4 and a seat part 5. Back part 4 and seat part 5 can each equipped with cushions 7.

In addition to back and seat parts 4 and 5, bench unit 3 includes a vertically adjustable support tube 8 guided on basic frame 2, an adjustment tube 9 coupled to one end to support tube 8 that carries back and seat parts 4 and 5, and a shaft tube 10 which is coupled to the end of adjustment tube 9 opposite support tube 8.

Basic frame 2 includes a base element 11 and an upright dumbbell support 12, which is secured to base element 11. Dumbbell support 12 can be vertically adjustable and can be provided at its upper end with a receiving element 13 for a dumbbell, or the like.

Furthermore, support tube 8 can be guided in a vertically adjustable manner on dumbbell support 12 and can be fixed by a clamping screw 14 in a desired position, e.g., either step by step or continuously, in accordance with the requirements of the user. At an upper end of support tube 8, a rest 15, e.g., a slide roll, can be arranged. The slide roll can be formed, e.g., of plastic. In addition, support tube 8 can be pivotably connected via a hinge 16 to adjustment tube 9.

Adjustment tube 9 may include a carrier tube 17 and an adjustment element 18, which is movably and fixably guided on carrier tube 17. An end of carrier tube 17 which is positioned to face away from support tube 8 can be pivotably coupled or hinged to shaft tube 10. Shaft tube 10 can be vertically adjustable. Further, the upper end of shaft tube 10 can include a roll adapted to receive, e.g., leg curl bars.

A clamping screw can be provided to selectively fix or release adjustment element 18 for sliding movement, thereby extending or contracting the effective length of carrier tube 17/adjustment element 18. Adjustment element 18 can be fixed by clamping screw 19 either in a stepwise manner or continuously.

Adjustment element 18 supports both back part 4 and seat part 5. To this end, adjustment element 18 may be connected to back part 4 via a support bow 20 which is guided on slide roll 15. Support bow 20 can be secured to a side of back part 4 that faces away from cushion 7. An attachment point between adjustment element 18 and support bow 20 can serves as a pivot point P, i.e., support bow 20 is pivotably supported on adjustment tube 18. Seat part 5 may also coupled via a carrier 21 to adjustment element 18, i.e., at pivot point P. In addition, carrier 21 can be pivotably adjusted with respect to adjustment element 18 via a support element 22.

A predominantly upright sitting position is illustrated in FIG. 1 by continuous lines. By contrast, the dash-dotted lines of FIG. 1 depict a position of the exercise apparatus 1 approaching a lying position. As can be seen in both respective positions of the bench unit 3, a displacement of adjustment element 18 toward the right can cause support bow 20 to roll on slide roll 15, which can result in a declining positioning of back part 4. At the same time, seat part 5 can be pushed toward the right and its position relative to the horizontal is changed, resulting, from an orthopedic point of view, in optimum contact surfaces for the buttocks and back of the exercising person. Therefore, a reason for the design of support bow 20, which includes a curved guideway, with different radii of curvature and at least one substantially straight section, and which is brought into contact with slide roll 15, enables respective positioning of back part 4. Slide roll 15 effects an adequate guidance of support bow 20 upon a positional change of back part 4 and seat part 5.

A preferred arrangement or design of support bow 20, including pivot point P, is illustrated in FIG. 1.

Figure 2:
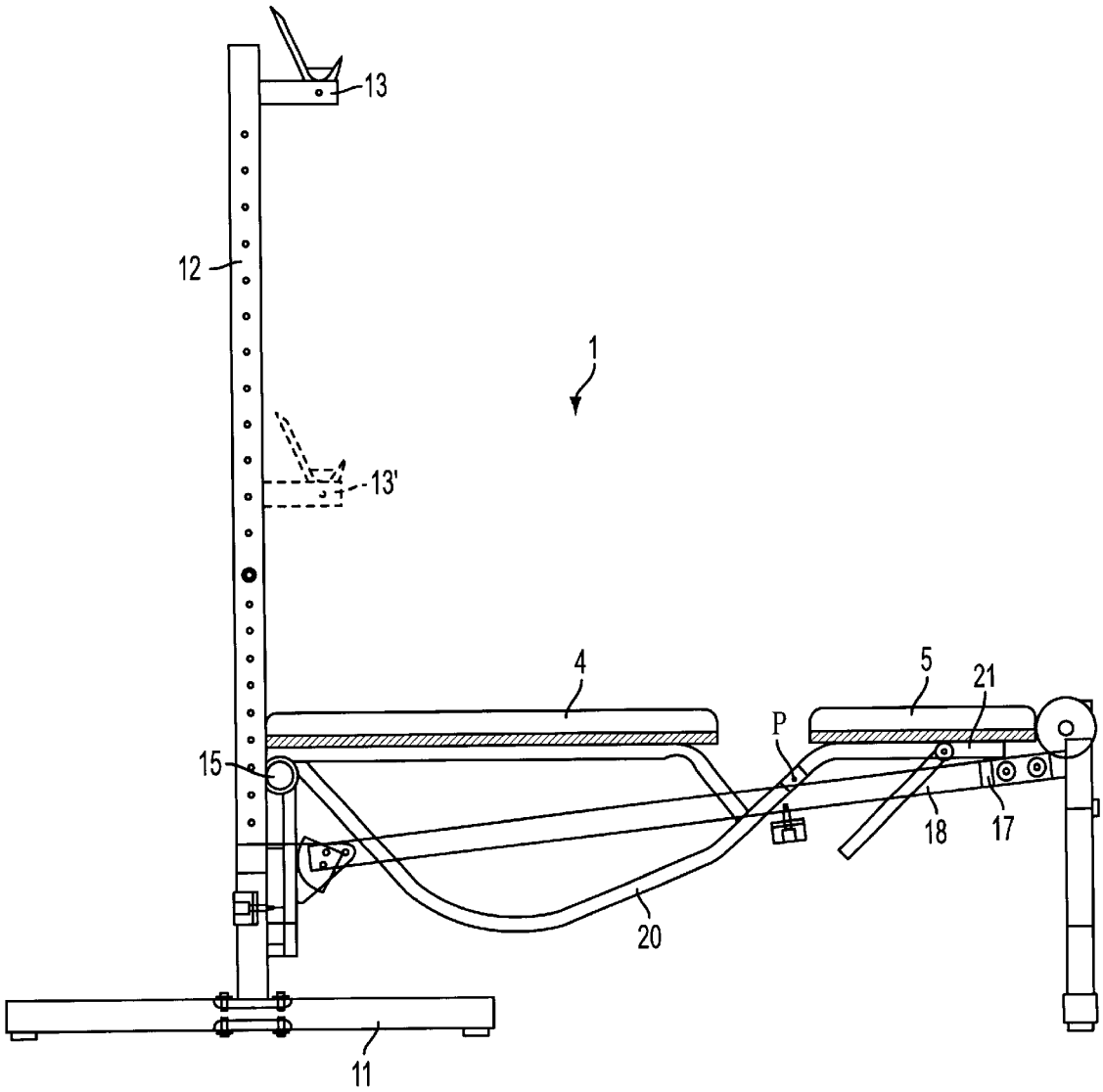
FIG. 2 illustrates a lateral sectional view of the exercise apparatus in a further lying position.
Figure 3:
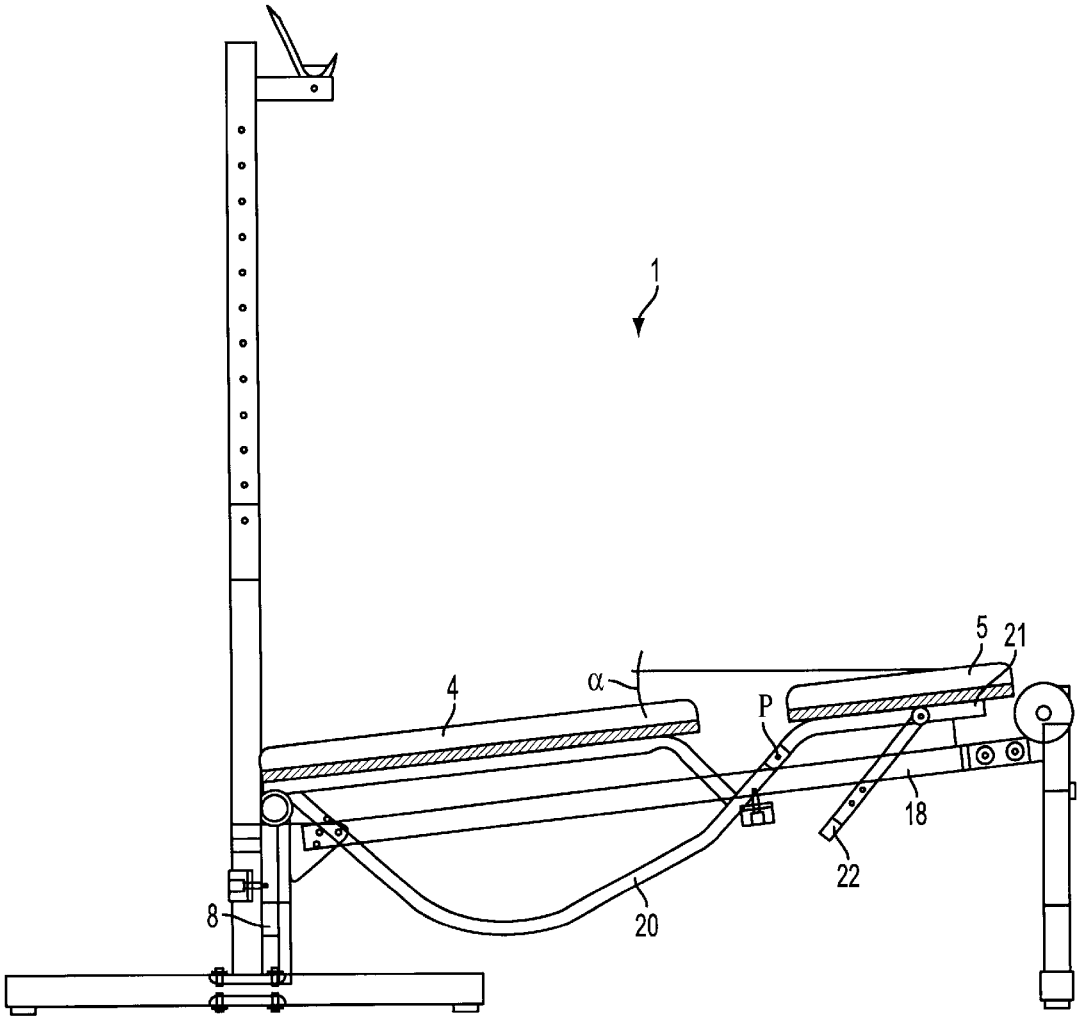
FIG. 3 illustrates a lateral sectional view of the exercise apparatus in a still further lying position.
Figure 4:
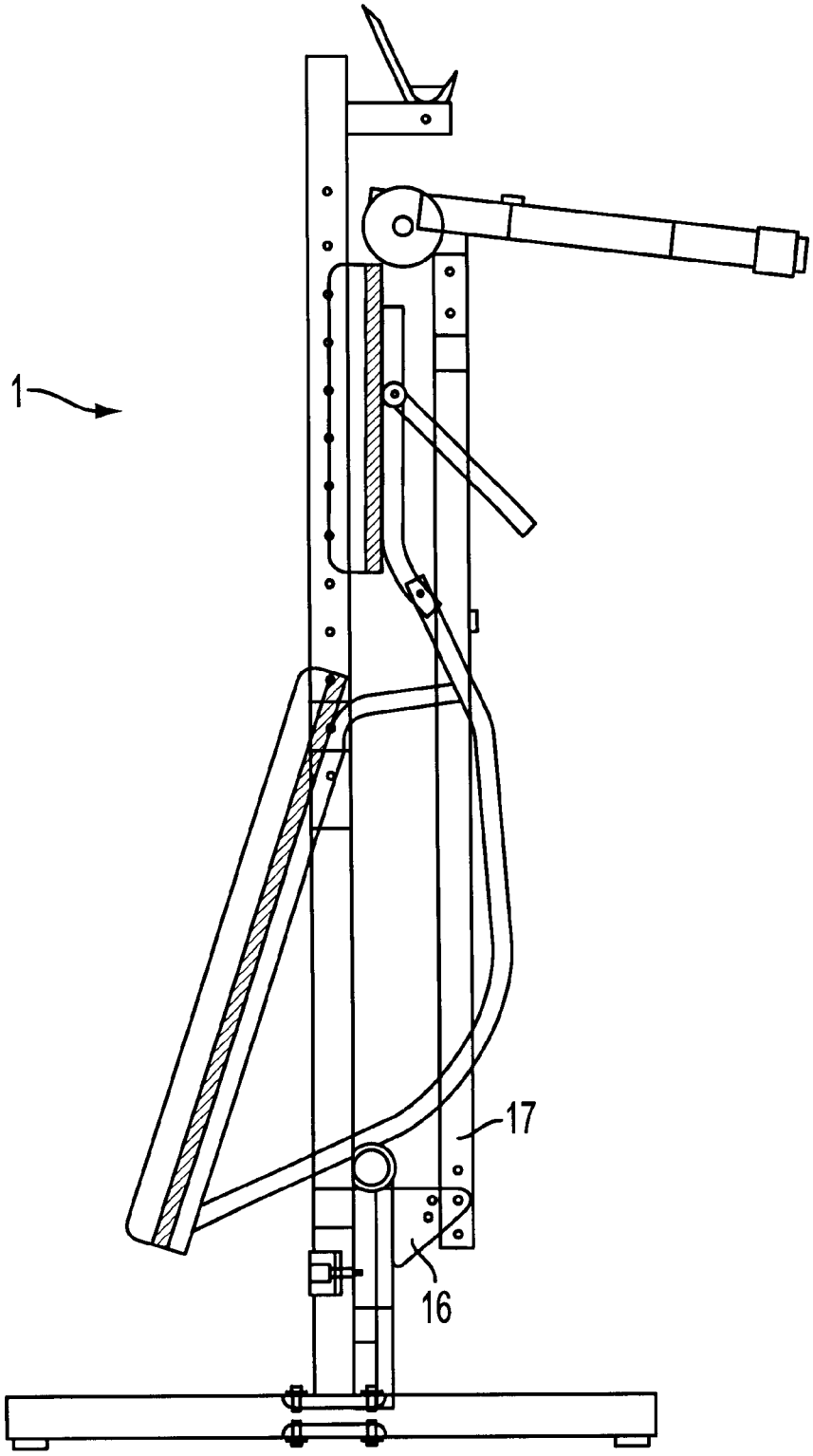
FIG. 4 illustrates a schematic lateral sectional view of the exercise apparatus of the invention in an upwardly folded position.

FIGS. 2–4 illustrate different positions of the exercise apparatus of the invention. In particular, FIG. 2 illustrates a lateral sectional view of dumbbell bench 1, in which both back part 4 and seat part 5 are located in a horizontal lying position. At a same time, receiving element 13 has been pushed or moved downwardly so that receiving element 13' can be reached by a person lying on the exercise apparatus and performing exercises with dumbbells. In such a lying position, support bow 20 has entirely run over slide roll 15, and an end of back part 4 that faces away from (or opposite) seat part 5 can now rest on slide roll 15. An end of carrier 21 which faces away from pivot point P can be in contact with carrier tube 17. As illustrated, adjustment element can be in its outermost right (most extended) position.

FIG. 3 illustrates a further lateral sectional view of exercise apparatus 1, in which the lying surface of back part 4 and seat part 5 are oriented at an angle $\alpha$, e.g., approximately 6°, relative to the horizontal. Such a further lowering of back and seat parts 4 and 5 is possible due to vertical movement of support tube 8, which can be guided downwardly along dumbbell support 12. However, even in such a position of back and seat parts 4 and 5, which is inclined downwardly at the head side, a straight lying surface can be maintained, which is achieved through the special articulated connection of support bow 20 to carrier 21 and adjustment element 18 at pivot point P, as well as to an articulated coupling of support element 22 to adjustment element 18 and to carrier 21. Further increase in angle $\alpha$ a can be provided by a vertically adjusting shaft tube 10.

FIG. 4 illustrates a lateral sectional view of exercise apparatus 1 in an upwardly folded state, i.e., carrier tube 17 has been folded upwardly at hinge 16 together with all of the components attached thereto. In contrast to the unfolded state, in which exercises can be performed thereon, the space required by folded-up arrangement of exercise apparatus 1 is reduced considerably. This feature can be of great advantage to fitness studios since such studios have to set up as many devices and dumbbells as possible within a very confined space. Thus, whenever exercise apparatus 1 is not needed, it can easily be brought or placed into the upwardly folded state, thus, providing free space for the use of other devices or dumbbells.

FIGS. 1–4 are lateral sectional views and structurally identical components, which may be offset in parallel, e.g., a respectively second basic frame, support tube, adjustment tube, shaft tube, etc., although not shown, could be (but need not be) inferred by one skilled in the art. Of course, the instant invention can also be practiced without any parallel offset components. In such a case, only slight modifications, which would be apparent to one skilled in the art, would be necessary, e.g., the arrangement of the bench unit on the basic frame for secure positioning.

Although the present invention has been described in combination with a dumbbell bench, the adjustment principle for the back and seat parts according to the invention can also be applied to other exercise apparatus in which the sitting or lying position is changed for exercising different muscle parts.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. An exercise apparatus comprising:

a basic frame;

a bench unit, comprising a back part and a seat part, which is vertically adjustable on said basic frame between a sitting position and a lying position;

a curved guideway, including at least one substantially straight section, being arranged to positionally adjust said back part.

2. An exercise apparatus comprising:

a basic frame;

a bench unit, comprising a back part and a seat part, which is vertically adjustable on said basic frame between a sitting position and a lying position;

a curved guideway, including at least one substantially straight section, being arranged to positionally adjust said back part;

said bench unit further comprising:

a vertically adjustable support tube adapted for movement on said basic frame;

an adjustment tube having an end coupled to said support tube, said adjustment tube being adapted to carry said back part and said seat part; and a shaft tube pivotably coupled to an other end of said adjustment tube.

3. The exercise apparatus according to claim 2, said adjustment tube comprising a carrier tube and an adjustment element, wherein said carrier tube is movably and fixably coupled to said carrier tube.

4. The exercise apparatus according to claim 3, wherein said curved guideway includes a plurality of different radii.

5. The exercise apparatus according to claim 4, wherein said curved guideway comprises a support bow.

6. The exercise apparatus according to claim 5, wherein said support bow is rigidly coupled to a surface of said back part is arranged to face said basic frame and is pivotably coupled to said adjustment element.

7. The exercise apparatus according to claim 5, further comprising a rest arranged on said support tube, wherein said support bow is supported on said rest.

8. The exercise apparatus according to claim 7, wherein said rest is a slide roll.

9. The exercise apparatus according to claim 7, wherein said seat part is pivotably coupled to said adjustment element and is adjustable together with said back part.

10. The exercise apparatus according to claim 9, wherein said back part and said seat part are pivotably coupled together at an attachment point, said attachment point is positioned on said adjustment element below said seat part.

11. The exercise apparatus according to claim 1, wherein said apparatus comprises a dumbbell bench.

12. An exercise apparatus comprising:

a positionably adjustable bench unit, comprising a back part and a seat part;

said back part being pivotably coupled to said seat part;

said seat part being movable along a substantially straight path; and said back part being movable along a curved path.

13. An exercise apparatus comprising:

a positionably adjustable bench unit, comprising a back part and a seat part;

said back part being pivotably coupled to said seat part;

said seat part being movable along a substantially straight path;

said back part being movable along a curved path;

a base frame comprising an upright part and a base part;

a shaft tube; and an extendible tube coupled between said upright part and said shaft tube, wherein said seat part is movable along said extendible tube.

14. The exercise apparatus according to claim 13, further comprising:

a support tube adjustably coupled for movement along said upright part;

a guide element comprising at least one substantially straight portion and at least one curved portion; and said guide element being slidably coupled to said support tube.

15. The exercise apparatus according to claim 14, wherein said curved portion comprises a plurality of different radii.

16. The exercise apparatus according to claim 14, further comprising a rest coupled to said support tube, wherein said guide element is slidably supported by said rest.

17. The exercise apparatus according to claim 16, said rest comprising a plastic roller.

18. The exercise apparatus according to claim 13, said extendible tube comprising a carrier tube and an adjustment element, wherein said adjustment element is slidably coupled to said carrier tube to selectively adjust a length of said extendible tube.

19. The exercise apparatus according to claim 13, further comprising:

a support element coupled to said seat part adapted to pivotably adjust a position of said seat part on said extendible tube.

20. The exercise apparatus according to claim 13, wherein said extendible tube is positionably adjustable along said upright part.

21. The exercise apparatus according to claim 13, wherein said extendible tube is pivotably coupled to said tube shaft and pivotably coupled to said upright part.

22. The exercise apparatus according to claim 13, wherein said tube shaft comprises an extendible tube for adjusting a length of said tube shaft.

23. The exercise apparatus according to claim 13, further comprising a roll coupled to upper end of said tube shaft.

24. The exercise apparatus according to claim 13, further comprising an attachment element that pivotably couples said seat part to said back part; and said attachment element being arranged for slidable engagement with said extendible tube.

25. The exercise apparatus according to claim 13, further comprising:

a guide element comprising at least one substantially straight portion and at least one curved portion;

said guide element being fixedly coupled to said back part and pivotably coupled to said seat part.

26. The exercise apparatus according to claim 25, further comprising a support tube coupled to said upright part; and said guide element being slidably coupled to said support tube.

27. The exercise apparatus according to claim 13, further comprising an equipment holder, said equipment holder being positionable along said upright part.

28. A process of adjusting an exercise apparatus that includes a basic frame, a bench unit, which includes a back part and a seat part, and a curved guideway, which includes at least one substantially straight section, said process comprising:

moving said bench unit so that the back part and the seat part are positionable between a lying position and a seated position, wherein the back part is moved along a path defined by the curved guideway.

29. The process according to claim 28, wherein the seat part is movable along a straight path.

30. The process according to claim 28, wherein the seat part and the back part are pivotably coupled to each other.

31. An exercise apparatus comprising:

a positionably adjustable bench unit, comprising a back part and a seat part;

said back part being pivotably coupled to said seat part;

said seat part being movable along a substantially straight path;

said back part being movable along a curved path;

a base frame comprising an upright part and a base part;

a shaft tube;

an extendible tube, comprising a carrier tube and an adjustment element, pivotably coupled to said upright part and pivotably coupled to said shaft tube, wherein said seat part is movable along said extendible tube, and wherein said adjustment element is slidably coupled to said carrier tube to selectively adjust a length of said extendible tube;

an attachment element that pivotably couples said seat part to said back part; and said attachment element being arranged for slidable engagement with said extendible tube.

32. The exercise apparatus according to claim 31, further comprising an attachment element that pivotably couples said seat part to said back part; and said attachment element being arranged for slidable engagement with said extendible tube.

* * * * *